US008470218B2

(12) United States Patent
Loubinoux et al.

(10) Patent No.: US 8,470,218 B2
(45) Date of Patent: Jun. 25, 2013

(54) PROCESS AND DEVICE FOR MANUFACTURING A COMPOSITE STRAND

(75) Inventors: Dominique Loubinoux, La Motte Servolex (FR); Bruno Gas, Pessac (FR)

(73) Assignee: OCV Intellectual Capital, LLC, Toledo, OH (US)

( * ) Notice: Subject to any disclaimer, the term of this patent is extended or adjusted under 35 U.S.C. 154(b) by 671 days.

(21) Appl. No.: 12/294,965

(22) PCT Filed: Mar. 23, 2007

(86) PCT No.: PCT/FR2007/050991

§ 371 (c)(1), (2), (4) Date: May 8, 2009

(87) PCT Pub. No.: WO2007/113431

PCT Pub. Date: Oct. 11, 2007

(65) Prior Publication Data

US 2010/0230851 A1 Sep. 16, 2010

(30) Foreign Application Priority Data

Mar. 30, 2006 (FR) ..... 06 51115

(51) Int. Cl.
*C03B 37/00* (2006.01)
*D01D 5/08* (2006.01)
*D01D 10/02* (2006.01)

(52) U.S. Cl.
USPC ..... 264/103; 264/171.1

(58) Field of Classification Search
USPC ..... 264/168, 103, 171.1
See application file for complete search history.

(56) References Cited

U.S. PATENT DOCUMENTS

| | | | | |
|---|---|---|---|---|
| 2,930,102 | A | 3/1960 | Hitchin | |
| 3,032,813 | A | 5/1962 | Stalego | |
| 3,072,518 | A | 1/1963 | White | |
| 3,091,018 | A | 5/1963 | Rees | |
| 3,134,704 | A | 5/1964 | Modigliani | |
| 3,269,818 | A | 8/1966 | Tiede | |
| 3,292,871 | A | 12/1966 | Smith et al. | |
| 3,844,497 | A | 10/1974 | Harrill | |
| 3,939,639 | A | 2/1976 | Ellegast | |
| 3,955,952 | A * | 5/1976 | Drummond | 65/438 |
| 4,230,284 | A | 10/1980 | Cunningham | |
| 4,342,579 | A | 8/1982 | Sanders | |
| 4,492,662 | A | 1/1985 | Larrive | |

(Continued)

FOREIGN PATENT DOCUMENTS

| | | |
|---|---|---|
| BE | 640075 | 5/1964 |
| CN | 1092016 | 9/1994 |

(Continued)

OTHER PUBLICATIONS

Office action from Russian Patent Application No. 2008138756 dated Feb. 25, 2011.

(Continued)

*Primary Examiner* — Joseph S. Del Sole
*Assistant Examiner* — Ryan Ochylski
(74) *Attorney, Agent, or Firm* — Calfee, Halter & Griswold LLP

(57) ABSTRACT

The invention relates to a process and a device for manufacturing a composite strand formed by combining continuous glass filaments with continuous high-shrinkage organic thermoplastic filaments.

10 Claims, 2 Drawing Sheets

U.S. PATENT DOCUMENTS

| | | | | |
|---|---|---|---|---|
| 4,762,750 | A | 8/1988 | Girgis et al. | |
| 4,774,042 | A | 9/1988 | Schippers | |
| 4,865,085 | A | 9/1989 | Ghiardo | |
| 5,011,523 | A | 4/1991 | Roncato | |
| 5,156,347 | A | 10/1992 | Gay | |
| 5,316,561 | A | 5/1994 | Roncato | |
| 5,422,180 | A | 6/1995 | Lukhard et al. | |
| 5,425,796 | A * | 6/1995 | Loubinoux et al. | 65/442 |
| 5,454,846 | A * | 10/1995 | Roncato et al. | 65/381 |
| 5,558,825 | A | 9/1996 | Ueda et al. | |
| 5,582,843 | A | 12/1996 | Sellars | |
| 5,626,643 | A | 5/1997 | Woodside et al. | |
| 5,744,089 | A | 4/1998 | Woodside et al. | |
| 5,811,480 | A | 9/1998 | Kirchmeyer et al. | |
| 5,913,268 | A * | 6/1999 | Jackson et al. | 101/420 |
| 6,025,073 | A | 2/2000 | Piret | |
| 6,027,680 | A | 2/2000 | Woodside et al. | |
| 6,074,590 | A | 6/2000 | Gownder | |
| 6,109,066 | A | 8/2000 | Loubinoux | |
| 6,190,768 | B1 | 2/2001 | Turley et al. | |
| 6,270,897 | B1 | 8/2001 | Flautt et al. | |
| 6,440,558 | B2 | 8/2002 | Klaus et al. | |
| 6,482,400 | B1 | 11/2002 | Collin | |
| 6,514,612 | B1 | 2/2003 | Moreau et al. | |
| 7,465,418 | B2 | 12/2008 | Boissonnat et al. | |
| 2002/0164192 | A1 | 11/2002 | Gueret | |
| 2005/0060980 | A1 * | 3/2005 | Howell et al. | 57/246 |
| 2006/0234028 | A1 | 10/2006 | Pardo | |
| 2008/0299856 | A1 | 12/2008 | Loubinoux et al. | |
| 2009/0126332 | A1 | 5/2009 | Boissonnat | |

FOREIGN PATENT DOCUMENTS

| | | |
|---|---|---|
| CN | 1107909 | 9/1995 |
| CN | 1479811 | 3/2004 |
| DE | 3617248 | 3/1987 |
| EP | 117415 | 9/1984 |
| EP | 199059 | 10/1986 |
| EP | 211748 | 2/1987 |
| EP | 299506 | 1/1989 |
| EP | 0 367 661 | 5/1990 |
| EP | 0 505 275 | 9/1992 |
| EP | 0 599 695 | 6/1994 |
| EP | 0 616 055 | 9/1994 |
| EP | 610147 | 9/1995 |
| FR | 1303213 | 9/1962 |
| FR | 2140443 | 1/1973 |
| FR | 2232620 | 2/1976 |
| FR | 2698038 | 5/1994 |
| JP | 55-016852 | 2/1980 |
| JP | 58-031111 | 2/1983 |
| JP | 58-041910 | 3/1983 |
| JP | 58-60032 | 4/1983 |
| JP | 2-70841 | 3/1990 |
| JP | 2-160907 | 6/1990 |
| JP | 2-243469 | 9/1990 |
| JP | 3-059038 | 3/1991 |
| JP | 3-270612 | 12/1991 |
| JP | 4-222246 | 8/1992 |
| JP | 5-207621 | 8/1993 |
| JP | 7-3358 | 1/1994 |
| JP | 6-220731 | 8/1994 |
| JP | 6-294795 | 10/1994 |
| JP | 7-96248 | 4/1995 |
| NO | 174635 | 4/1990 |
| NO | 175683 | 9/1992 |
| RU | 2110625 | 5/1998 |
| RU | 2126367 | 2/1999 |
| WO | 93/06055 | 4/1993 |
| WO | 96/10660 | 4/1996 |
| WO | 96/40596 | 12/1996 |
| WO | 97/10101 | 3/1997 |
| WO | 98/01751 | 1/1998 |
| WO | 98/18737 | 5/1998 |
| WO | 00/26155 | 5/2000 |
| WO | 02/28948 | 4/2002 |
| WO | 02/31231 | 4/2002 |
| WO | 02/31235 | 4/2002 |
| WO | 02/059055 | 8/2002 |
| WO | 03/093545 | 11/2003 |
| WO | 2006/54025 | 5/2006 |
| WO | 2007/113431 | 10/2007 |
| WO | 2007/116181 | 10/2007 |

OTHER PUBLICATIONS

Office action from Chinese Application No. 200780011598.2 dated Dec. 31, 2010.
Office action from Russian Application No. 2008138756 dated Oct. 7, 2011.
Office action from Chinese Application No. 200780018736.X dated Jan. 11, 2012.
Notice of Allowance from U.S. Appl. No. 12/266,592 dated Jan. 6, 2012.
International Search Report from PCT/FR97/01184 dated Nov. 28, 1997.
International Search Report and Written Opinion from PCT/FR01/02979 dated Dec. 6, 2001.
International Preliminary Examination Report from PCT/FR01/02979 dated Mar. 20, 2002.
International Search Report and Written Opinion from PCT/FR05/50960 dated Apr. 7, 2006.
International Search Report and Written Opinion from PCT/FR07/51067 dated Aug. 17, 2007.
International Search Report and Written Opinion from PCT/FR07/50991 dated Sep. 17, 2007.
Office action from U.S. Appl. No. 08/152,554 dated Jun. 1, 1994.
Office action from U.S. Appl. No. 08/152,554 dated Nov. 15, 1994.
Notice of Allowance from U.S. Appl. No. 08/152,554 dated Mar. 10, 1995.
Office action from U.S. Appl. No. 09/029,606 dated Jan. 24, 2000.
Notice of Allowance from U.S. Appl. No. 09/029,606 dated May 3, 2000.
Office action from U.S. Appl. No. 10/398,509 dated Jun. 29, 2005.
Office action from U.S. Appl. No. 10/398,509 dated Dec. 9, 2005.
Office action from U.S. Appl. No. 10/398,509 dated May 2, 2006.
Advisory Action from U.S. Appl. No. 10/398,509 dated Jul. 10, 2006.
Office action from U.S. Appl. No. 10/398,509 dated Dec. 12, 2006.
Office action from U.S. Appl. No. 10/398,509 dated May 22, 2007.
Office action from U.S. Appl. No. 10/398,509 dated Oct. 24, 2007.
Office action from U.S. Appl. No. 10/398,509 dated Jun. 4, 2008.
Notice of Allowance from U.S. Appl. No. 10/398,509 dated Aug. 11, 2008.
Office action from U.S. Appl. No. 11/719,455 dated Jun. 4, 2010.
Office action from U.S. Appl. No. 11/719,455 dated Dec. 8, 2010.
Office action from U.S. Appl. No. 12/266,592 dated Jun. 24, 2010.
Notice of Allowance from U.S. Appl. No. 12/266,592 dated Dec. 10, 2010.
Notice of Allowance from U.S. Appl. No. 12/266,592 dated Apr. 1, 2011.
Office action from Australian Application No. 50447/93 dated Aug. 2, 1995.
Office action from Australian Application No. 50447/93 dated Aug. 19, 1996.
Office action from Canadian Application No. 2,103,313 dated Jun. 9, 2003.
Office action from Canadian Application No. 2,425,222 dated Feb. 3, 2009.
Office action from Chinese Application No. 93114244.X dated Mar. 26, 1998.
Office action from Chinese Application No. 97191223.8 dated May 10, 2002.
Office action from Chinese Application No. 01820406.6 dated Jul. 18, 2006.
Office action from Chinese Application No. 01820406.6 dated Nov. 16, 2006.
Office action from Chinese Application No. 01820406.6 dated May 31, 2007.
Office action from Chinese Application No. 200580046779.X dated Sep. 4, 2009.

Office action from Czech Republic Application No. 2490/93 dated May 20, 1997.
Office action from Czech Republic Application No. 2490/93 dated Nov. 1997.
Search Report from EP Application No. 93402783 dated Feb. 17, 1994.
Communication from EP Application No. 01972213.1 dated Jan. 21, 2004.
Search Report from French Application No. 0651115 dated Dec. 11, 2006.
Search Report from FR Application No. 00 12990 dated Jan. 10, 2003.
Search Report from FR Application No. 656,366 dated Jul. 4, 2005.
Search report from FR Application No. 678,022 dated Dec. 14, 2006.
Office action from Hungarian Application No. 9303276 dated Mar. 18, 1997.
Office action from Hungarian Application No. 9303276 dated Apr. 6, 1998.
Office action from Indian Application No. 697/Cal/93 dated Jul. 25, 1996.
Office action from Indian Application No. 1239/Cal/97 dated Mar. 3, 2003.
Office action from Indian Application No. 1239/Cal/97 dated Jan. 14, 2004.
Office action from Indian Application No. 401/KOLNP/2003 dated Oct. 5, 2007.
Office action from Japanese Application No. 5-290935 dated May 8, 2001.
Office action from Japanese Application No. 10-504855 dtaed Feb. 7, 2006.
Office action from Japanese Application No. 10-504855 dated Sep. 19, 2006.
Office action from Japanese Application No. 2002-534596 dated Mar. 29, 2011.
Office action from Korean Application No. 10-1998-0701757 dated Feb. 2, 2005.
Office action from Korean Application No. 10-2003-7004997 dated Apr. 17, 2007.
Office action from Mexican Application No. 93.07210 dated Jan. 26, 1998.
Office action from Norwegian Application No. P934036 dated Nov. 1, 1995.
Office action from Norwegian Application No. P934036 dated Jul. 30, 1996.
Office action from Norwegian Application No. 934036 dated Oct. 25, 1996.
Office action from Norwegian Application No. 934036 dated Jan. 31, 1997.
Office action from Norwegian Application No. 934036 dated Sep. 3, 1997.
Office action from Polish Application No. 301,085 dated Nov. 22, 1996.
Office action from Russian Application No. 93051360 dated Dec. 20, 1997.
Office action from Russian Application No. 98106476 dated Jun. 20, 2001.
Office action from Russian Application No. 2003113213 dated 2005.
Office action from Slovakia Application No. PV 0317-98 dated Oct. 12, 2004.
Office action from Taiwanese Application No. 86116776 dated Dec. 22, 1998.
Anter Laboratories, Inc. Linear Thermal Expansion Data Sheet 1988.
Notice of Allowance from U.S. Appl. No. 12/266,592 dated Oct. 6, 2011.

* cited by examiner

PROCESS AND DEVICE FOR MANUFACTURING A COMPOSITE STRAND

BACKGROUND

The invention relates to a process and a device for manufacturing a composite strand formed by combining a multiplicity of continuous glass filaments with continuous high-shrinkage organic thermoplastic filaments.

The manufacture of composite strands is disclosed especially in EP-A-0 367 661 which describes a process employing a first installation comprising a bushing that contains molten glass, from which continuous glass filaments are drawn, and a second installation comprising a spinning head, supplied under pressure with an organic thermoplastic that delivers continuous filaments.

The two types of filaments are assembled into at least one composite strand and during the assembly the filaments may be in the form of webs, or in web and strand form. In the composite strand, the glass filaments or strand are surrounded by thermoplastic filaments that protect the glass from rubbing on the solid surfaces with which the strand is in contact.

Although the incorporation of thermoplastic filaments enables the abrasion resistance of the strand to be improved, it also introduces tensions in the strand due to a shrinkage phenomenon of said filaments, which causes waviness of the glass filaments. The presence of waviness is particularly visible when the composite strand is wound in the form of a bobbin as this is deformed over its entire periphery.

The shrinkage phenomenon has several drawbacks: it requires resorting to thick spools for producing the bobbins so that they can withstand the shrinking exerted by the composite strand and it disrupts the unwinding of the strand from the bobbin due to the fact that it does not have the ideal geometric characteristics that are required for the desired application. Furthermore, such a strand is not advantageous for producing a fabric that can be used as a reinforcing material for large-size flat parts since, because of the waviness, the filaments are not perfectly aligned in the final composite. The reinforceability of the strands in a given direction is found to be reduced.

To solve the problem of shrinkage of the thermoplastic filaments, various solutions have been proposed.

In EP-A-0 505 275, a process for manufacturing a composite strand similar to that described previously in EP-A-0 367 661 is proposed, which plans to form the thermoplastic filaments using a spinning head that is normally used in the field of the synthetic fibre industry. In this way, it is possible to obtain a composite strand formed from one or more glass strands surrounded by organic filaments, which is independent of the configuration of the spinning head used for extruding the organic filaments.

In EP-A-0 599 695, it is proposed to mingle the thermoplastic filaments with glass filaments at a speed during the commingling that is greater than the drawing speed of the glass filaments. The speed difference is determined so that the shrinkage phenomenon compensates for the excess initial length of the thermoplastic filaments relative to the glass filaments.

In one embodiment, the thermoplastic filaments pass onto a variable speed drawing unit of the type comprising drums, which accentuates the excess length, which makes it possible to obtain a composite strand of which the glass filaments are linear and the thermoplastic filaments are wavy.

In EP-A-0 616 055, a process for producing a glass/thermoplastic composite strand is also proposed, which consists in mingling a web of thermoplastic filaments with a bundle or a web of glass filaments, the thermoplastic filaments being, upstream of the point of convergence, heated to a temperature above their relaxation temperature, drawn then cooled. The composite strand obtained has no waviness and is stable over time.

The direct manufacture of rovings, without passing through an intermediate step of unwinding the tape and winding the strand, is carried out continuously by drawing the composite strand under the bushing at a speed compatible with the drawing of the glass filaments. This already high speed (of the order of a few meters to about ten meters per second) is associated with a drawing speed of the thermoplastic filaments upstream of the convergence points that is even higher.

The production of a composite strand without waviness under such conditions occurs via a precise synchronization of the relative speeds of the rotating elements of the drawing unit and by maintaining the initial difference between the drawing speeds of the glass filaments and the thermoplastic filaments.

These conditions are limited to thermoplastic materials that undergo a limited shrinkage. When the shrinkage is larger, the drawing unit becomes inoperable due to the fact that its speed can no longer be increased so as to sufficiently increase the length of the thermoplastic filaments so that the composite strand does not have any waviness.

SUMMARY

The object of the present invention is to provide a process enabling the manufacture of a composite strand comprising commingled continuous high-shrinkage thermoplastic filaments and continuous glass filaments that does not have any waviness during its manufacture and that remains stable over time.

This object is achieved via a process for manufacturing a composite strand formed by commingling continuous glass filaments mechanically drawn from the holes in a bushing filled with molten glass and continuous organic thermoplastic filaments emanating from a spinning head, said thermoplastic filaments being mingled in the form of a web with a bundle or a web of glass filaments, in which, before their commingling with the glass filaments, the thermoplastic filaments are drawn, heated then projected onto a moving support with a speed during their projection onto the support that is greater than the running speed of said support. The combined effect of the drawing and the projection of the heated thermoplastic filaments gives them a high level of crimping that consequently makes it possible to compensate for the shrinkage of the thermoplastic in the composite strand.

Advantageously, the heating and protection of the thermoplastic filaments are carried out simultaneously.

According to a first embodiment of the invention, the thermoplastic filaments are guided in the form of a web up to the glass filaments, also in the form of a web, and are combined with the latter at identical speeds between the coating roll and the point of gathering all the filaments into a composite strand.

According to another embodiment, the thermoplastic filaments are projected onto the glass filaments deposited onto the moving support, in the running direction of said support. Thus a web formed by the entanglement of the crimped thermoplastic filaments with the linear glass filaments is obtained, this web consequently being assembled to form the composite strand.

The process according to the invention makes it possible to obtain a composite strand without any waviness: the glass filaments that are incorporated into the composition of the composite strand are linear immediately after their assembly with the thermoplastic filaments, and they retain their linearity after the collection in the form of a package. In the end, the thermoplastic filaments in the composite strand may be linear or wavy depending on the level of crimping that has been conferred on them at the beginning.

Thanks to the invention, it is possible to form bobbins under the normal conditions for producing glass strands, especially using spools of conventional thickness given the absence of shrinkage of the composite strand, these spools possibly being removed in order to obtain balls and reused if necessary. This has the advantage of being able to extract the composite strand according to the method of unwinding (from the outside) or unravelling (from the inside).

Besides the fact that it makes it possible to obtain a composite strand without waviness using a high-shrinkage thermoplastic, the process according to the invention ensures a homogeneous distribution and a high commingling of the filaments within the composite strand.

The invention also provides a device for carrying out this process.

According to the invention, in order to enable the manufacture of a composite strand formed from continuous glass filaments and from continuous high-shrinkage thermoplastic filaments, this device comprises, on the one hand, an installation comprising at least one bushing supplied with molten glass, the lower face of which has a very large number of holes, this bushing being associated with a coating device, and on the other hand, an installation comprising at least one spinning head supplied under pressure with molten organic thermoplastic, the lower face of which is equipped with a very large number of holes, this spinning head being associated with a drawing unit of the type comprising drums, with a device for projecting thermoplastic filaments that is provided with heating means, with a drum-type moving support and with a means enabling the thermoplastic filaments to be mingled with the glass filaments, finally means common to the two installations enabling the assembly and winding of the composite strand.

The drum drawing unit has at least two rolls operating at variable speeds, preferably ensuring an increasing linear speed of the thermoplastic filaments. When the drawing unit comprises more than two rolls, the latter advantageously operate in pairs. The drawing unit may be provided with heating means, for example electric or infrared heating means, preferably placed in the first drum encountered by the thermoplastic filaments with the objective of preheating them and thus promoting their drawing.

Preferably, the means enabling the thermoplastic filaments to be projected onto the moving support is a device using the properties of fluids that may be liquids or gases, such as pulsed or compressed air. Advantageously, it is a Venturi system, the role of which is solely to project the thermoplastic filaments by giving them an adequate spatial distribution and orientation, without giving them any additional speed.

According to a preferred embodiment of the invention, the heating means, especially electrical, are associated with the device ensuring the projection of the thermoplastic filaments. In this way, the heating of the thermoplastic filaments at a temperature close to their softening point is carried out homogeneously and rapidly, which makes it possible to obtain a satisfactory crimping state during the projection onto the moving support.

The moving support may be made from a drum, the surface of which consists of perforations, comprising an element for separating the internal volume into at least two compartments, one connected to means enabling it to be maintained under vacuum, the other associated with means enabling it to be put under excess pressure. The size and placement of the compartments are chosen so as to maintain the thermoplastic filaments in their initial crimping state, in the form of a web at the surface of the drum situated above the first compartment, and to obtain the separation of the web when it passes above the second compartment.

The means enabling the two types of filaments to be mingled may be constituted by a Venturi system as described previously that enables the thermoplastic filaments to be projected into a web or a bundle of glass filaments. Preferably, this system projects the thermoplastic filaments at an identical speed to the drawing speed of the glass filaments.

The means ensuring the commingling of the filaments may also be constituted by the drum-moving support. In this case, the drum is used to support the web of glass filaments, which winds around it, and the crimped thermoplastic filaments in web form are mingled with the glass filaments along a generatrix of the drum.

The devices described previously enable the production of composite strands, from precrimped high-shrinkage thermoplastic filaments and from glass filaments, which do not have any subsequent deformation, that is to say that remain stable over time.

Such devices can be applied to any type of known glass, for example E-glass, R-glass, S-glass, AR-glass or C-glass, E-glass being preferred.

In the same way, it is possible to use any thermoplastic capable of having a high shrinkage, for example a polymer belonging to the group of polyurethanes, polyesters such as polyethylene terephthalate (PET) and polybutylene terephthalate (PBT), and polyamides such as nylon-6, nylon-6,6, nylon-11 and nylon-12.

BRIEF DESCRIPTION OF THE DRAWINGS

Other details and advantageous features of the invention will become apparent on reading the description of the examples of devices for carrying out the invention described with reference to the appended figures that represent.

DESCRIPTION

Figure 1:
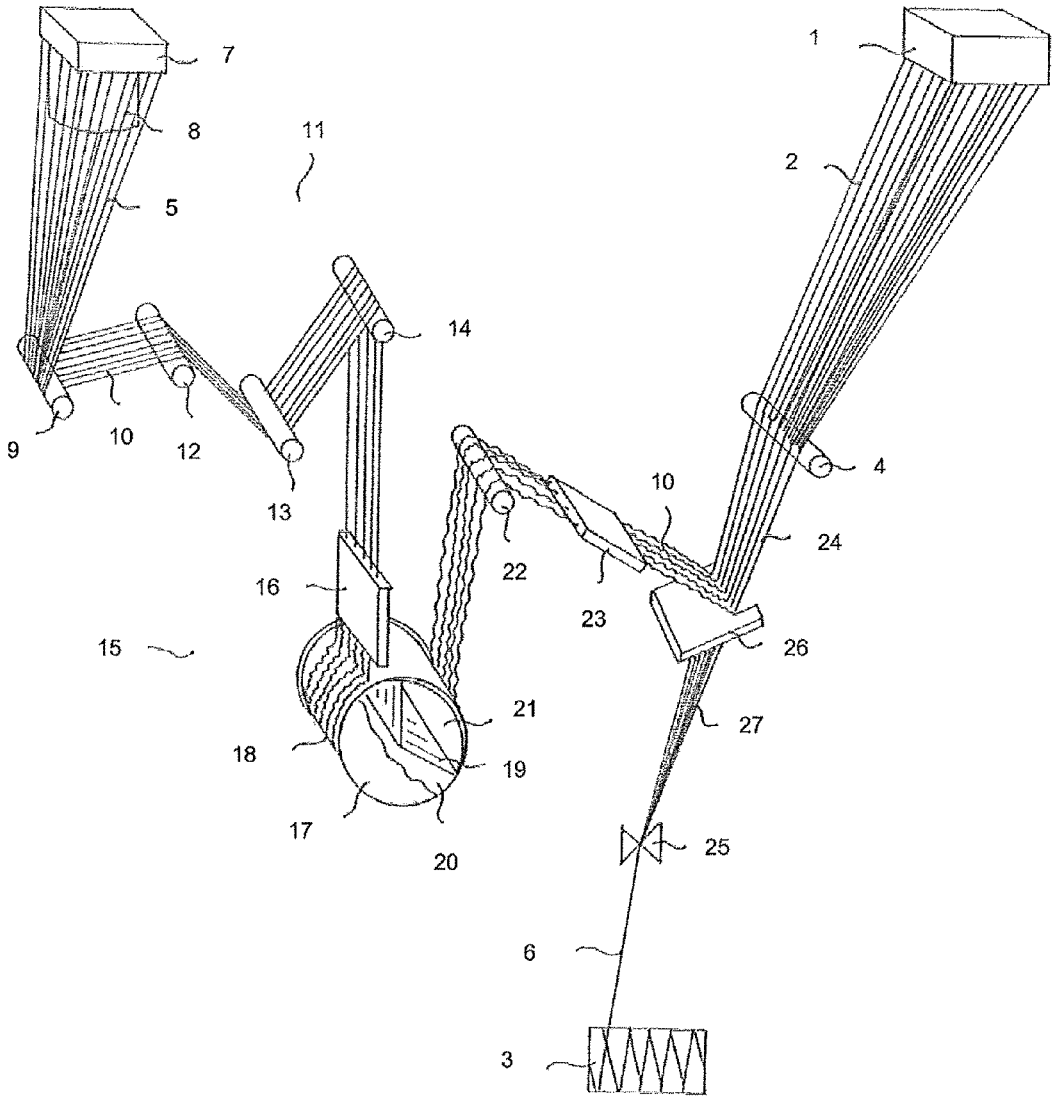
FIG. 1: a schematic representation of an installation according to the invention.

Represented in FIG. 1 is a schematic view of a complete installation according to the invention. It comprises a bushing 1 supplied with molten glass either via a hopper containing cold glass, for example in the form of beads that drop simply by gravity, or from the forehearth of a furnace that feeds glass directly to its top.

Whatever the type of feed, the bushing 1 is usually made of a platinum-rhodium alloy and it is heated by resistance heating so as to remelt the glass or keep it at a high temperature. A multitude of streams of molten glass flow from the bushing 1, these streams are drawn in the form of a bundle 2 of filaments by a device, not shown, also allowing the bobbin 3 to be formed. Placed in the path of the bundle 2 is a coating roll 4, for example made of graphite, which deposits a size onto the glass filaments that is intended to prevent or limit the rubbing of the filaments on the members with which they come into contact. The size may be aqueous or anhydrous (that is to say comprising less than 5% by weight of water) and contain compounds, or derivatives of these compounds, which are incorporated into the composition of the thermoplastic filaments 5 that will combine with the glass filaments to form the composite strand 6.

Also represented schematically in FIG. 1 is a spinning head 7 from which the thermoplastic filaments 5 are extruded. The spinning head 7 is supplied with a molten, high-shrinkage thermoplastic, for example coming from an extruder, not shown, supplied with granules which flows under pressure through a large number of holes positioned under the spinning head 7, to form the filaments 5 by drawing and cooling. Cooling of the filaments is carried out by forced convention, by means of a conditioning device 8 having a suitable shape for the spinning head 7 and that generates a laminar air flow perpendicular to the filaments. The cooling air has a flow rate, a temperature and a humidity that are kept constant. The filaments 5 then pass over a roll 9 that makes it possible to assemble them in the form of a web 10, on the one hand, and to deflect their path, on the other hand.

After passing over the roll 9, the web 10 of thermoplastic filaments passes over a drawing unit 11 formed, for example, from rolls 12, 13 that may turn at the same speed or have different speeds so that the acceleration is carried out in the run direction of the thermoplastic filaments. The drawing unit 11 has the role of drawing the filaments 5 and of giving a set speed to the web 10. It is possible to vary the rotational speed of rolls 12 and 13 so as to precisely adjust the projection speed of the thermoplastic filaments onto the drum 17. Rolls 12 and 13 may be associated, where appropriate, with a heating system, for example an electric heating system, which makes it possible to ensure a homogeneous and rapid preheating of the thermoplastic filaments by contact with the surface of the rolls. The drawing unit 11 may be formed from a higher number of rolls, preferably functioning in pairs, for example four or six rolls.

The web 10 of thermoplastic filaments, optionally preheated, is then directed towards the deflecting roll 14, which may be heated and optionally be motor-driven, then it passes into a crimping device 15 formed, for example from a Venturi system 16 and a drum 17.

The Venturi system 16 makes it possible to keep the thermoplastic filaments separate and to project them as a regular web of suitable size onto the drum 17. The Venturi system 16 operates by an injection of compressed air and imparts no additional speed to the web 10. This system is associated with a heating device (not shown), for example using a fluid such as hot air or steam, and has the role of bringing the thermoplastic filaments to a temperature close to the softening point of the thermoplastic in order to improve their crimpability.

At the outlet of the Venturi system 16, the web 10 of thermoplastic filaments is projected onto the drum 17. The rotational speed of the drum 17 is lower than the speed of the web 10 during its projection so that the filaments crimp when they come into contact with the surface of said drum.

The drum 17 is equipped with a central groove 18, having a width slightly less than that of the drum, which is pierced by multiple holes (not shown). It also comprises an element 19, that is coaxial and immobile relative to the drum, which is used to separate the interior of the drum into two compartments 20, 21. Compartment 20 is connected to a device, not shown, which enables it to be put under vacuum, for example a suction pump, and compartment 21 is connected to a device, not shown, enabling it to be put under an excess pressure, for example an air injection device.

After its projection onto the drum 17, the web 10 of crimped filaments is held in the groove 18 level with the compartment 20 under vacuum and it is cooled, by simple contact with the perforated surface or via a fluid, for example water or a sizing composition sprayed onto the filaments. Next, the web 10 is separated from the surface of the drum 17 level with the compartment 21 under the effect of the pressurized air passing through the perforations.

The web 10 then passes onto a deflecting roll 22, then into a Venturi device 23 that keeps the crimped thermoplastic filaments in individual form until they are mingled with the glass filaments of the web 24.

Joining of the web 10 of thermoplastic filaments and the web 24 of glass filaments takes place between the coating roll 4 and the element 25 being used to assemble the filaments into a composite strand. During the commingling of the filaments, the thermoplastic filaments arrive with a speed equal to that of the glass filaments.

A deflector 26 equipped with a notch keeps all the filaments in place, in particular along the edges, and helps to reduce the disturbance undergone by the web 24 of glass filaments at the moment when the web 10 of crimped thermoplastic filaments is projected onto it.

The web 27 of intermingled crimped thermoplastic filaments and glass filaments then passes onto the device 25 that enables assembly of the filaments into a composite strand 6, which is immediately wound in the form of a bobbin 3 thanks to a drawing device, not shown, that operates at a given linear speed kept constant to guarantee the desired linear density.

This linear speed that enables the drawing of the glass filaments is in general equal to that imparted by the drum 17 to the web 10 of crimped thermoplastic filaments. Nevertheless, it is possible to mingle the thermoplastic filaments with the glass filaments at a speed, during their projection, which may be lower in order to given an extra tension to the thermoplastic filaments to improve the ability to keep them in web form until the point of commingling with the glass filaments. Under these conditions, the difference between the projection speed of the thermoplastic filaments and the drawing speed of the glass filaments does not exceed 10%.

Figure 2:
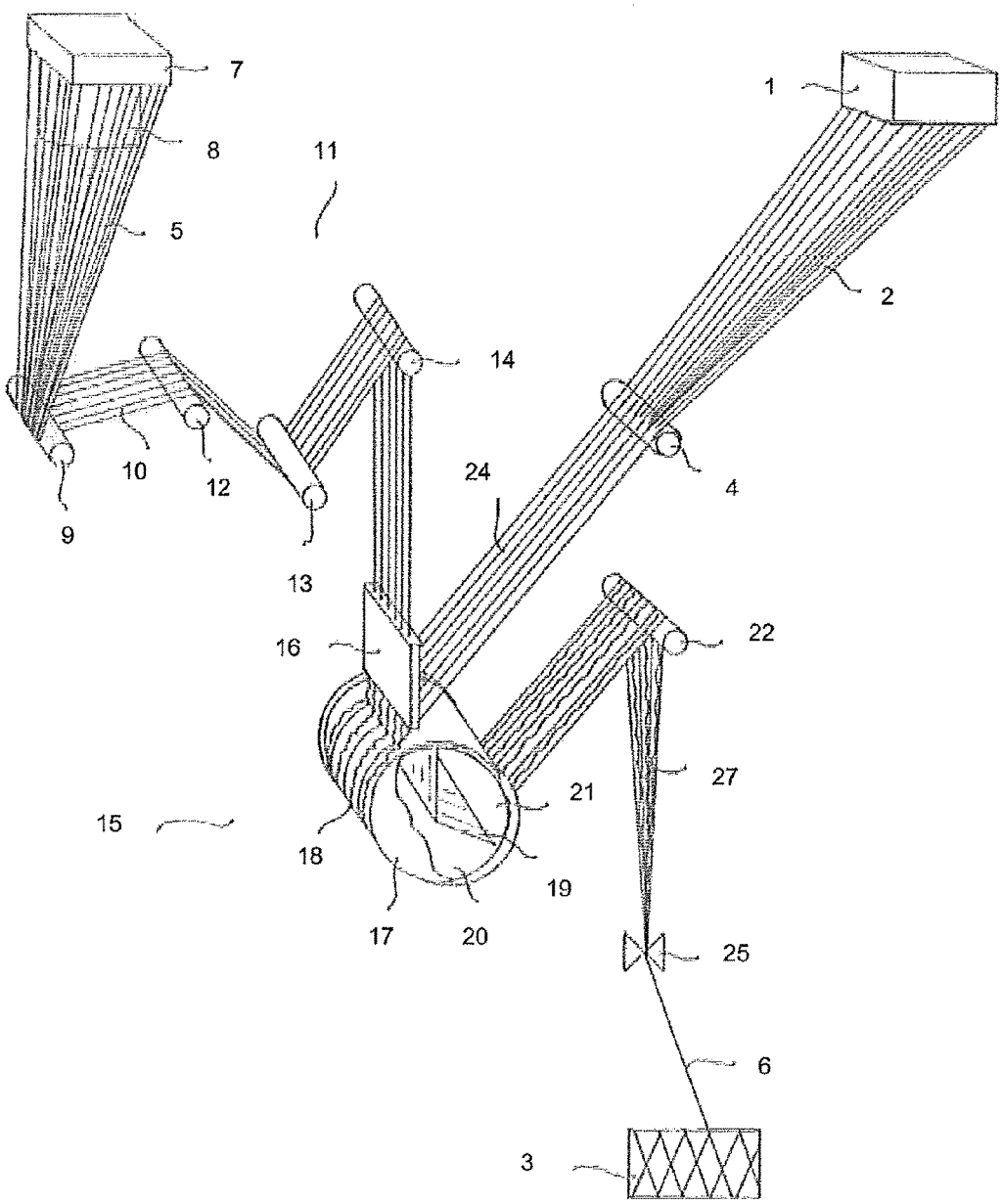
FIG. 2: a schematic representation of a second embodiment of the invention.

FIG. 2 represents an installation according to a second embodiment of the invention. In this figure, the common devices and means bear the same numbers as in FIG. 1.

The bundle 2 of glass filaments flowing from the bushing is drawn by a device (not shown) that forms the bobbin 3. The bundle 2 passes over the coating roll 4 that deposits a size on the glass filaments and the web 24 formed is wound over the drum 17.

The thermoplastic filaments 5 extruded from the spinning head 7, cooled by the conditioning device 8 are assembled into a web 10 level with the roll 9. The web 10 then passes onto the drawing unit 11 having rolls 12, 13 and is drawn under the same conditions as in FIG. 1. After roll 13, the web 10 is directed towards the roll 14, that is optionally heated and/or motor-driven, and into the crimping device 15 formed from the Venturi system 16 and the drum 17.

In the Venturi system, the thermoplastic filaments of the web 10 are kept in their individual state and are heated at a temperature close to the softening point in order to help to obtain a high level of crimping.

The heated web 10 is projected onto the drum 17 that rotates at a lower speed than the projection speed of the filaments, which crimps them. Joining of the web 10 of crimped thermoplastic filaments and the web 24 of glass filaments is carried out along a generatrix of the drum 17. The projection of the web 10 takes place while the filaments of the web 24 are contained within the groove 18 of the drum 17; this way of proceeding avoids disturbing the web of glass filaments and thus makes it possible to reduce the risk of said filaments breaking.

Immediately after their joining with the web 24, the crimped thermoplastic filaments intermingle with the glass filaments and are flattened to the bottom of the groove 18 level with the compartment 20 under vacuum. When the web of thermoplastic filaments and glass filaments wound up onto the drum 17 arrives level with the compartment 21 that is under the action of pressurized air, it is detached from the surface under the effect of the air pressure coming from the inside of said compartment.

The web 27 passes onto the roll 22 and onto the device 25 for gathering the filaments into a composite strand 6, which is wound in the form of the bobbin 3. A second device 25 may be placed between the exit of the drum 17 and the roll 22 in order to help to obtain a better assembly of the composite strand.

The bobbins obtained using the process according to the invention are composed of a composite strand, of which the glass filaments are linear and the thermoplastic filaments are crimped (or wavy) in a way that is permanent and stable over time. The level of crimping or waviness of the thermoplastic filaments in the composite strand depends on the size of the crimping that was given to them during projection onto the moving support.

Moreover, the distribution of the glass filaments and the thermoplastic filaments within the composite strand is homogeneous, which translates into good commingling of the filaments.

It is possible to apply some modifications to the process and device that have just been described. Firstly, it is possible to use a size made up of several solutions, whether aqueous or not, comprising compounds that are capable of copolymerizing over a relatively short time when they are brought into contact with each other. In this case, the coating device comprises separate rolls, each of them depositing one of the sizing solutions on the glass filaments. It is also possible to anticipate a drying device that enables water to be removed from the glass filaments, or at least for the water content to be substantially reduced, before winding.

It is also possible to combine the invention with the production of complex composite strands, that is to say composite strands comprising organic thermoplastics that have different shrinkages. For this, it is possible to form different types of filaments, for example from one or more spinning heads, and to project them, in individual form or after having been assembled, onto the glass filaments.

EXAMPLE 1

A composite strand was manufactured in the installation described in FIG. 1 under the following conditions:

- thermoplastic filaments:
  - thermoplastic: polyethylene terephthalate (PET);
  - number of filaments: 1200 filaments;
  - linear density: 359 tex;
  - flow rate of the device 8: 500 $m^3$/h;
  - speed of the drawing unit: 1500 m/min; temperature of rolls 12 and 13: 240° C.; draw ratio in the melt phase: 1560;
  - air temperature in the Venturi device 16: 260° C.;
  - rotational speed of the drum 17: 990 m/min; cooling by water-spraying; and
  - degree of crimping: 8%.
    - The degree of crimping was measured according to the formula $100\times(L-L_o)/L_o$, in which $L_o$ is the length of a crimped filament and L is the length of the same filament after a sufficient drawing to make it linear.
- glass filaments:
  - number of filaments: 1600;
- composite strand:
  - glass/thermoplastic weight ratio: 75/25;
  - linear density: 1491 tex; and
  - linear speed (winding): 1000 m/min.

The bobbin 3 was dried in an oven at 118° C. for 32 hours. The shrinkage of the thermoplastic filaments was around 6%. The geometry of the bobbin was not changed after drying.

EXAMPLE 2

A composite strand was manufactured in the installation described in FIG. 2 under the following conditions:

- thermoplastic filaments:
  - thermoplastic: polyamide (PA);
  - number of filaments: 1200 filaments;
  - linear density: 466 tex;
  - flow rate of the device 8: 400 $m^3$/h;
  - speed of the drawing unit: 1800 m/min; temperature of rolls 12 and 13: 180° C.; draw ratio in the melt phase: 3640;
  - air temperature in the Venturi device 16: 200° C.;
  - rotational speed of the drum 17: 1008 m/min; cooling by water-spraying; and
  - degree of crimping: 10%.
    - The degree of crimping was measured according to the formula $100\times(L-L_o)/L_o$, in which $L_o$ is the length of a crimped filament and L is the length of the same filament after a sufficient drawing to make it linear.
- glass filaments:
  - number of filaments: 1600;
- composite strand:
  - glass/thermoplastic weight ratio: 70/30;
  - linear density: 1597 tex; and
  - linear speed (winding): 1008 m/min.

The bobbin 3 was dried in an oven at 118° C. for 32 hours. The shrinkage of the thermoplastic filaments was around 7%. The geometry of the bobbin was not changed after drying.

The invention claimed is:

1. A process for manufacturing a composite strand formed by the blending of continuous glass filaments and continuous thermoplastic filaments comprising the steps of:

- drawing said glass filaments into a web;
- drawing said thermoplastic filaments into a web;
- passing said web of thermoplastic filaments through a pre-crimping system to separate the thermoplastic filaments and to raise a temperature of said thermoplastic filaments to a temperature less than the thermoplastic softening temperature;
- projecting said web of thermoplastic filaments onto a moving support, wherein the speed of said moving support is less than the speed of said projected thermoplastic filaments, thereby forming a web of crimped thermoplastic filaments;
- passing said web of said thermoplastic filaments through a post-crimping system to separate said thermoplastic filaments; and
- blending said web of crimped thermoplastic filaments with said web of said glass filaments to form a composite strand;
- wherein said step of projecting said web of thermoplastic filaments to form the web of crimped thermoplastic filaments is performed prior to said blending.

2. The process according to claim 1, wherein said blending further comprises:

projecting said web of crimped thermoplastic filaments onto said web of said glass filaments between a coating roller and a device for gathering said filaments into said composite strand.

3. The process according to claim 2, wherein said projecting of said web of crimped thermoplastic filaments onto said web of said glass filaments occurs with said web of crimped thermoplastic filaments and said web of said glass filaments each moving at identical speeds.

4. The process of claim 1, wherein said thermoplastic filaments are characterized by having a degree of shrinkage sufficient to allow said blending to produce a waveless composite strand.

5. The process of claim 1, wherein said thermoplastic filaments have been crimped in an amount of less than about 10 percent.

6. The process of claim 1, wherein said step of projecting a web of thermoplastic filaments onto a moving support is achieved using a Venturi system.

7. The process of claim 6, wherein said step of projecting a web of crimped thermoplastic filaments onto said web of said glass filaments is achieved using a second venturi system.

8. The process of claim 1, wherein said moving support is a drum having a central groove with a width slightly smaller than the width of said drum.

9. The process of claim 8, wherein said drum comprises perforations in a drum surface.

10. The process of claim 8, wherein an inside of said drum is divided into two compartments, a first compartment being under low pressure relative to an outside of the drum, and a second compartment being under high pressure relative to the outside of the drum.

* * * * *